United States Patent [19]

Seligson

[11] 4,107,954

[45] Aug. 22, 1978

[54] CIRCULAR KNITTING MACHINE PROVIDED WITH A NOVEL STRIPING BOX

[76] Inventor: Charles Seligson, 160 E. 38th St., New York, N.Y. 10018

[21] Appl. No.: 702,858

[22] Filed: Jul. 6, 1976

[51] Int. Cl.[2] ..... D04B 15/58

[52] U.S. Cl. ..... 66/133; 66/138; 66/156

[58] Field of Search ..... 66/133, 138, 156, 201

[56] References Cited

U.S. PATENT DOCUMENTS

| | | | |
|---|---|---|---|
| 2,351,756 | 6/1944 | Gluck | 66/133 |
| 2,378,780 | 6/1945 | Lombardi | 66/201 X |
| 2,691,879 | 10/1954 | Seiler | 66/201 X |
| 3,048,990 | 8/1962 | Moyer | 66/138 |
| 3,620,049 | 11/1971 | Mishcon et al. | 66/138 |

FOREIGN PATENT DOCUMENTS

| | | | |
|---|---|---|---|
| 770,247 | 6/1934 | France | 66/156 |
| 174,550 | 9/1906 | Fed. Rep. of Germany | 66/156 |
| 1,164,451 | 9/1969 | United Kingdom | 66/138 |

*Primary Examiner*—Wm. Carter Reynolds
*Attorney, Agent, or Firm*—Michael J. Striker

[57] ABSTRACT

A circular knitting machine has a rotating needle cylinder provided with cylinder needles disposed about the periphery of the cylinder and a plurality of yarn feeding stations at least some of which are provided with striping boxes. Each striping box has a plurality of yarn-holding members individually activatable for causing yarn from different ones of the yarn-holding members of the striping box to be fed to needles travelling past the striping box. According to the novel method, more than one of the yarn-holding members of the striping box of at least one of the feeding stations are kept simultaneously activated during at least part of a rotation of the needle cylinder so that each of at least some of the needles being fed yarn at such station during such part of a rotation will receive yarn from each of the more than one activated yarn-holding members.

4 Claims, 15 Drawing Figures

DRUM-INDEXING ACTUATOR OPERATING IN SYNCHRONISM WITH NEEDLE CYLINDER ROTATION

FIG. 1
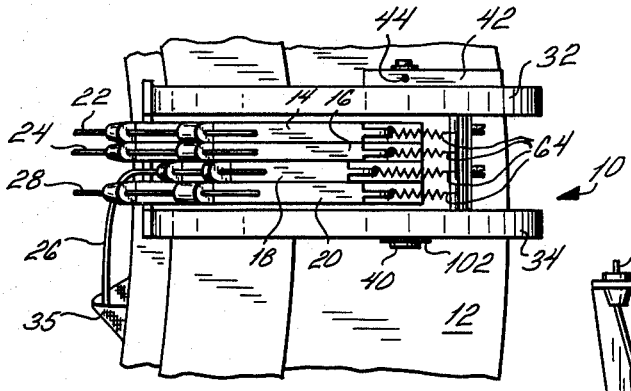
FIG. 2
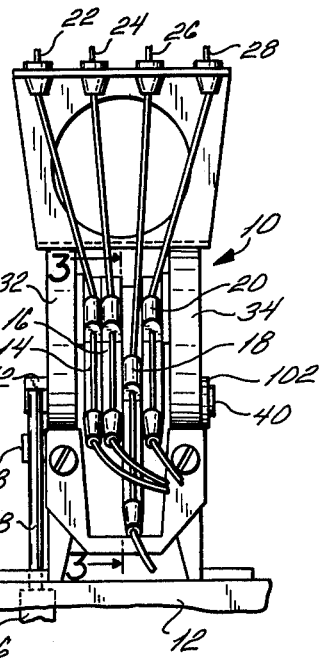
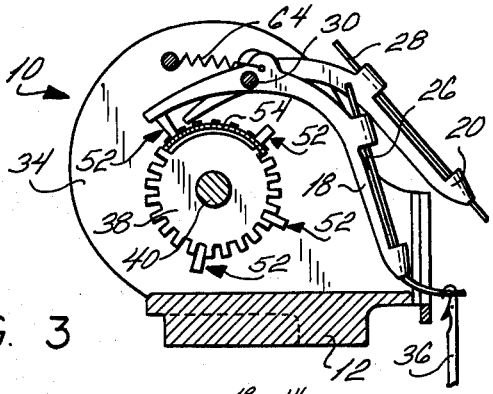
FIG. 3
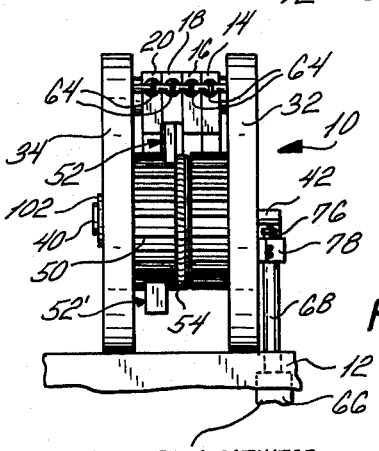
FIG. 4
DRUM-INDEXING ACTUATOR OPERATING IN SYNCHRONISM WITH NEEDLE CYLINDER ROTATION PRIOR ART
FIG. 8
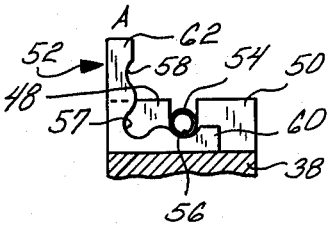
PRIOR ART
FIG. 9
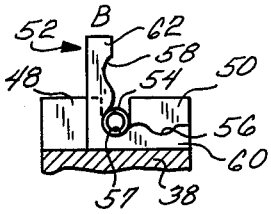
PRIOR ART
FIG. 10
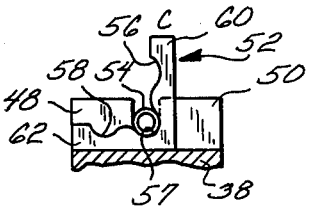
PRIOR ART
FIG. 11
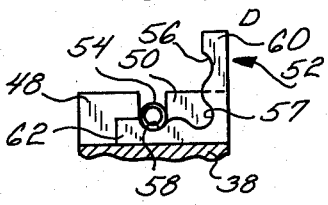
FIG. 12
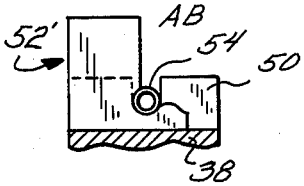
FIG. 13
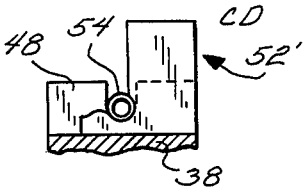
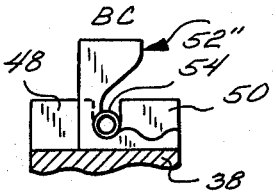
FIG. 14
FIG. 15
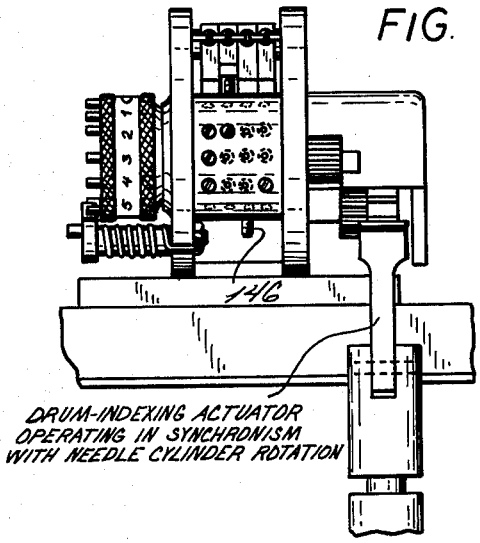

CIRCULAR KNITTING MACHINE PROVIDED WITH A NOVEL STRIPING BOX

BACKGROUND OF THE INVENTION

The invention relates to the patterning of circular knitting machines.

The use of striping boxes to increase the versatility of patterns which can be knit on a circular knitting machine is very well known. Conventionally, each striping box is comprised of a plurality of yarn-carrying fingers or other members, for example four such fingers. Often, each feeding station of the circular knitting machine will be provided with a striping box.

Depending upon which one of the four yarn-carrying fingers of each striping box is in dropped or activated state, a different one of four different yarns will be fed to needles travelling past the striping box. By controlling the activation and deactivation of the yarn-carrying fingers at the feeding stations of the machine in accordance with a preselected pattern, it is possible to knit patterns which could not otherwise be produced.

The most common use of striping boxes is in the formation of club stripes, i.e., horizontal stripes having a height, expressed in courses, equal to a multiple of the number of courses which the knitting machine could otherwise produce per needle cylinder rotation if its feeding stations were not provided with striping boxes.

Conventionally, the yarn-carrying fingers of the striping box are activated and deactivated under the control of a control drum provided with removably mounted finger-activating jacks. The jacks may have the form of flat members which are inserted into holding recesses or alternatively pins which are screwed or pushed into holding sockets of the drum. In the latter case, the control drum is provided with a plurality of such holding portions arranged in tracks, each track being associated with one yarn-carrying finger, the holding portions furthermore being arranged in rows, each row corresponding to a predetermined rotation of the needle cylinder.

The control drum is indexed in synchronism with needle cylinder rotation in a manner which is very well known. Usually a control chain is provided having high and low links. The control chain is driven in synchronism with the rotation of the needle cylinder, one link per cylinder rotation. A high link on the control chain causes the control drum to be indexed by one step, whereas a low link on the control chain fails to index the control drum; i.e., the control drum idles. When the control drum is indexed one step in this manner, one control jack or pin will move out of the finger-activating position and another will move into the finger-activating position. If the second control member (jack or pin) is in the same track as the one which it replaces, there will be no change in the activation of the yarn-carrying fingers and the same yarn will continue to be fed; if the second control member is in a track different from the one in which was located the pin which it replaces, then there will be a change in the activation of the yarn-carrying fingers and a different yarn (for example, yarn of a different color) will be fed.

For reasons well known in the art, it is often desired to form a knitted cloth using thick yarns, to give bulk to the cloth or to create any of a variety of special effects. When the feeding station is provided with a striping box, it is conventional practice to thread one of the yarn-carrying fingers of the striping box with the thick yarn. When the thick yarn is to be employed, the finger on which it is threaded is activated. Usually, the thick yarn is too thick to be actually knit and is instead utilized merely as the float for any of a variety of types of lay-in cloth.

A significant drawback of threading one of the thick lay-in yarns onto a yarn-carrying finger of a striping box is that the versatility of the striping box becomes reduced. If the striping box has only four yarn-carrying fingers, then one fourth of its capacity is relegated to the carrying of a yarn which can be laid in only and not knit, or which can at most be knit to the extent of one or a few stitches. This decrease of capacity becomes most apparent, for example, when the pattern to be knit consists of a succession of differently colored and/or patterned horizontal stripes, with only one or a few of the stripes requiring the thick lay-in yarn. Likewise, if two successive stripes of lay-in cloth are to be produced utilizing a thick lay-in yarn of different color for each of the stripes, then two of the four yarn-carrying fingers must be set aside for carrying the two thick lay-in yarns, one for the one stripe and the other for the second. This means that only the two remaining yarn-carrying fingers are available for the carrying of yarn which can actually be knit. This clearly limits very greatly the variety of stripe colors which can be produced.

SUMMARY OF THE INVENTION

It is a general object of the invention to provide a new type of striping-box action which considerably increases the patterning flexibility of circular knitting machines provided with striping boxes.

This general object, and other more specific objects which will become more understandable from the subsequent description of preferred embodiments, can be met, according to one advantageous concept of the invention, by keeping more than one of the yarn-holding members of the striping box of at least one of the feeding stations of the circular knitting machine simultaneously activated so that each of at least some of the needles being fed yarn at such station will receive yarn from each of the more than one activated yarn-holding members.

This expedient makes it possible to achieve several important advantages.

If, for example, the first, second, third and fourth yarn-carrying fingers of each striping box of the knitting machine are respectively threaded with red, blue, white and black yarn, then there exists the possibility of using any combination of two of these yarns to form a double-thickness float for knitting lay-in cloth. Thus, for example, the white and black yarn-carrying fingers may be simultaneously dropped so that the float fed by these fingers to needles travelling past the striping box will consist of one white and one black yarn. The white and black yarn together will give the visual impression of a tweedy colored yarn or, depending upon the size of the yarn and the tightness of the knit and subsequent surface finishing (such as brushing) may even combine to give the impression of a gray lay-in float. If this two-yarn black-white float is utilized to knit a tall club stripe of lay-in cloth, such stripe can be followed by another tall club stripe which utilizes, for example, white but no black yarn, or black but no white yarn. For example, the following club stripe can be a stripe of lay-in cloth wherein the float consists of two yarns, for example a white yarn and a blue yarn, with the body of the stripe being of red yarn and no black yarn being used whatsoever in such stripe.

It will be appreciated that in this way the patterning and design capacity of the knitting machine is greatly increased. On the one hand, it is not necessary to set aside one or more of the yarn-carrying fingers for the holding of a thick lay-in yarn not utilizable for ordinary knitting; on the contrary, the yarn threaded onto each of the yarn-carrying members can be used for ordinary knitting. At the same time, the number of different floats which can be formed for the production of lay-in cloth, or a stripe of lay-in cloth, is greatly increased, being equal to the number of combinations of two different yarns, 16 in the case of four yarn-carrying fingers.

A comparison with the design capacity of prior-art striping boxes can be made in numerical terms. If one considers a prior-art four-finger striping box wherein one finger is relegated to the carrying of a thick yarn which can be used only for lay-in effects and is too thick for actual knitting, then there is available a total of three yarns for knitting and one yarn for a lay-in float. With a comparable four-finger striping box according to the invention, there are available four, not three, yarns for knitting and 16, not just one, different lay-in floats possibilities.

It is possible in some circumstances to simultaneously drop more than two fingers, to combine more than two yarns in forming a lay-in float. When that is feasible, the design flexibility of the knitting machine is even further increased.

A further advantage of the inventive expedient resides in the elimination of the need of back winding two yarns together to form special-order combined yarns for use as lay-in floats. For example, it is known to back wind together two yarns when it is desired to form lay-in fabric wherein the lay-in float is of two colors. Such backwinding is disadvantageous per se in that it requires a separate winding operation. In addition, once two yarns have been backwound to form a combined yarn, it is not feasible to subsequently unwind them to regain the individual component yarns. This is particularly significant because, due to uncertainty as to the actual amount of backwound two-color lay-in yarn which may be needed, it is conventional practice to backwind an amount considerably in excess of the actual need, to avoid an insufficient supply. As a consequence, when a particular order has been filled, the knitter is often left with a supply of two-color backwound combined yarn for which he has no immediate need, or no need whatsoever. Supplies of such unneeded two-color backwound yarn are often accumulated in great quanitity, without any assurance that they can ever be utilized.

The present invention eliminates the need for this expensive, time-consuming and awkward practice of the prior art by making it possible in effect to form two-color yarns for lay-in floats or heavy jersey ends right at the striping box itself, as the production of cloth actually proceeds, and with no commitment to the formation of any particular amount of two-color yarn.

Furthermore, it can actually be more advantageous to form two-color lay-in floats according to the invention than through the use of backwinding. This is because when two yarns of different color are backwound together to form a thicker two-color yarn for a lay-in float, the twisting together of the two component yarns may decrease the extent to which such yarns can be subsequently processed, compared to the extent to which the combined yarns formed according to the present invention can be subsequently processed. For example, if the lay-in cloth is to be brushed, floats formed of component yarns which are not twisted together may be more effectively brushed than backwound float yarns.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a fragmentary top plan view showing the striping box of the invention on a circular knitting machine;

FIG. 2 is an elevational view of the striping box of FIG. 1 taken from the inside of the circular knitting machine;

FIG. 3 is a diagrammatic cross sectional view on the plane of the line 3—3 of FIG. 2;

FIG. 4 is an elevational view of the striping box of FIG. 1 taken from the outside of the circular knitting machine;

FIG. 8 is a fragmentary sectional view showing a conventional finger-actuating jack in one position between drum teeth;

FIG. 9 is a fragmentary sectional view showing the jack of FIG. 8 in a second position between the drum teeth;

FIG. 10 is a fragmentary sectional view showing the jack in a third position between the drum teeth;

FIG. 11 is a fragmentary sectional view showing the jack in a fourth position between the drum teeth;

FIG. 12 is a view similar to FIG. 8 showing one novel jack in a first position between the drum teeth;

FIG. 13 is a view showing the jack of FIG. 12 in a second position between the drum teeth;

FIG. 14 depicts a further novel jack in position between the drum teeth; and FIG. 15 depicts a striping-box control drum of different design wherein the jacks are replaced by removable control pins.

DESCRIPTION OF THE PREFERRED EMBODIMENTS

Figure 5:
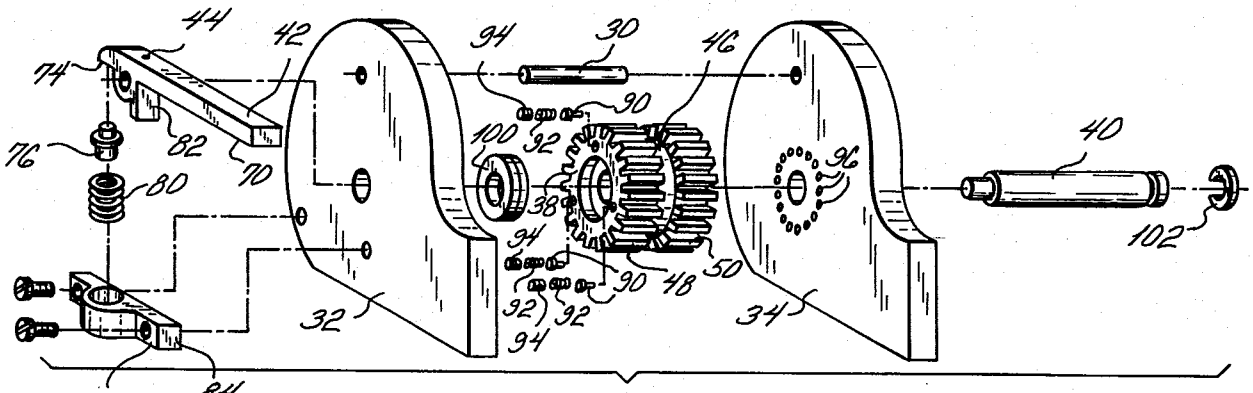
FIG. 5 is an enlarged exploded view showing portions of the striping box of FIG. 1.
Figure 6:
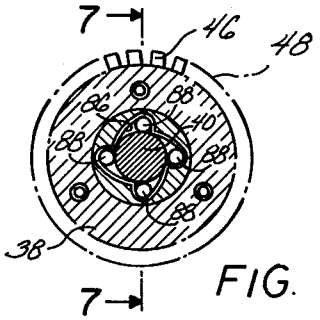
FIG. 6 is a cross sectional view of the drum of the striping box.

Referring to the drawings, as disclosed in U.S. Pat. No. 3,620,049, reference character 10 designates one of a plurality of striping boxes mounted on a stationary carrier ring 12. The striping box 10 contains four striping fingers or yarn carriers 14, 16, 18 and 20, such fingers being of conventional construction and containing apertures through which extend yarns 22, 24, 26 and 28, respectively, from cones on a yarn stand (not shown).

The striping fingers are pivotally mounted on rod 30 between check plates 32 and 34, and are each movable between an upper inoperative position and a lower operative position. When a selected finger such as finger 18 is in its lower operative position, the yarn 26 carried thereby is operatively engageable with a needle 36 whereby the yarn may be knitted into a fabric 35. Movement of the striping fingers from their inoperative to their operative positions determine which striping yarns are incorporated into the fabric.

Each striping box contains an inner rotatable drum 38 mounted on a shaft 40 having one end affixed to an operating lever 42 as by set screw 44. The drum 38 includes a midline annular groove 46 and the like teeth 48 and 50, respectively, on opposite sides of the groove. L-shaped jacks 52 are mounted in selected spaces between the teeth of drum 38 to actuate the striping fingers 14, 16, 18 and 20. Such jacks are held in the drum by a spring 54 which registers with the groove 46 and engages the jacks in one of the recesses formed in the jacks.

Each finger has connected thereto a spring 64 normally urging the rear arm of the finger downwardly and the yarn carrying end of the finger upwardly. The rear arm of a finger, if not engaged by a jack 52, rests upon the surface of the drum teeth and the yarn carrying end of the finger is in its inoperative position. The drum may, however, be moved to bring a jack into a position under the end of the rear arm and so cause elevation of the rear arm and a consequent depression of the forward part of the finger, whereby the finger is brought into its operative position (see finger 18 in FIGS. 1, 2 and 3).

The striping box is operated by an actuator 66 which is responsive to a camming mechanism (not shown) of the type described for example in U.S. Pat. No. 2,543,121. In per se conventional manner, the camming mechanism is controlled by a control chain consisting of high and low links. The control chain is advanced by conventional means one link per rotation of the needle cylinder. A high link activates the camming mechanism and causes the latter to cause the drum 38 to be indexed by one step, so that the next aligned pair of recesses 96 and the jack (if any) therein moves into the position wherein a yarn-carrying finger 14, 16, 18 or 20 becomes activated. A low link in the chain does not activate the camming mechanism, so that the drum 38 will idle, i.e., it will not be indexed during the needle cylinder rotation corresponding to the low link. Actuator 66 includes push rod 68 which acts on one end of lever 42 at 70, the other end 74 of the lever being engageable with a plunger 76 slidably mounted in member 78 and biased against lever 42 by a spring 80. Spring 80, acting through lever 42, urges the push rod 68 to a position wherein flange 82 on the lever engages surfaces 84 on member 78, and the spring is effective to return the lever to such stop engaging position after actuation of the lever by push rod 68.

Figure 7:
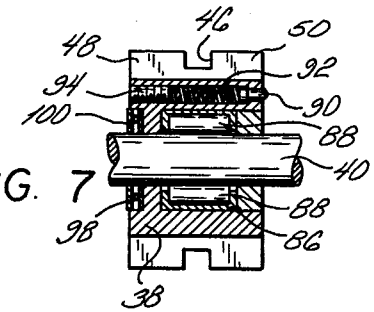
FIG. 7 is a sectional view taken on the plane of line 7—7 of FIG. 6.

Drum 38 is operatively connected to a uni-directional roller clutch comprising race 86 affixed in the drum, and rollers 88. The shaft 40 directly engages the rollers 88 and also forms part of the clutch. Whenever lever 42 is actuated by push rod 68, shaft 40 which is affixed to the lever 42 turns a fraction of a revolution and causes the clutch rollers 88 to bind in the race 86 such that the drum is immediately forced to turn with the shaft. As shown the drum 38 includes a number of detents 90 which project from one end surface of the drum, such detents being biased outwardly by springs 92 held in the drum by screws 94. A plurality of recesses 96 equal in number to the number of pairs of aligned teeth in the drum 38 are provided in check plate 34 to receive the detents 90 and cause the drum when actuated by lever 42 acting through shaft 40 to move into a precise position which is defined by engagement of detents 90 in recesses 96 and wherein a pair of slots between adjacent teeth 48 and 50 and any jack therein is disposed directly under the extreme end of the rear part of a striping finger such that the finger is moved into its operative position. After the drum 38 is positioned by the shaft 40, the lever 42 is returned to its stop engaging position by spring 80 and the shaft turns with the lever but without moving the drum which maintains a fixed position wherein the detents 90 register in recesses 96. When the drum is rotated to remove a jack from under a finger, the finger is moved into its inoperative position by attached spring 64. As may be seen in FIG. 7 the shaft 40 is supported for rotation relative to the drum 38 on a ball bearing 98 mounted in a thrust washer 100 which is affixed in the drum. C-ring 102 supports the shaft 40 against longitudinal movement in one direction and the lever 42 prevents longitudinal movement of the shaft in the other direction.

Although striping box 10 has been described as having striping fingers 14, 16, 18 and 20 movable between an upper inoperative position and a lower operative position, it should be appreciated that the striping box construction described is not the only possible construction and that in another construction the striping fingers might, for example, be spring biased toward a lower inoperative position and be subject to actuation by jacks of the striper drum into an upper operative position.

Jacks 52 are located in particular slots of the drum and in particular locations within the slots to provide for operation of the striping levers in a predetermined sequence. As noted hereinbefore, the jacks 52 may be disposed with leg 62 in position A or in position B, and the jacks may also be disposed with leg 60 in position C or position D. The jacks 52 may be slid under the spring 54 between positions A and B or between positions C and D, and may be pivoted (FIG. 10) about the spring 54 between positions B and C. The jack 52 for any particular pair of slots of the drum may therefore readily be positioned to operate any one of the striping fingers 14, 16, 18 or 20.

It will be appreciated that each of the four positions of the jack 52 shown in FIGS. 8–11 causes the activation of a different respective one of the four yarn-carrying fingers 14, 16, 18 or 20. Only one yarn-carrying finger can be actuated at a time using these jacks.

FIGS. 12, 13 and 14 show the use of novel jacks 52' and 52''. In FIG. 12, jack 52' has one leg which is of a breadth such as to cause the simultaneous activation of two of the yarn-carrying fingers, corresponding to positions A and also B of the single jack 52. In FIG. 13, jack 52' has been reversed so as to cause the simultaneous activation of the two yarn-carrying fingers corresponding to positions C and D of the single jack 52. FIG. 14 depicts a further novel jack 52'' so configurated as to simultaneously activate the two yarn-carrying fingers corresponding to positions B and C of the single jack 52. The jack 52'' of FIG. 14 has the advantage over the jack 52' that it can be moved into any of the three positions, so as to simultaneously activate the left two, the middle two, or the right two yarn-carrying fingers 14, 16, 18, 20. It will be appreciated that other designs for the jacks are also possible. For example, a jack can be designed to simultaneously activate the leftmost one and the rightmost one of the four yarn-carrying fingers.

FIG. 15 depicts another well known conventional construction for the control drum of a striping box.

Control drum constructions of this type are disclosed, for example, in U.S. Pat. Nos. 2,543,121 and 2,549,701. Here, the jacks 52, 52' or 52" are replaced by a single, a pair, or three control pins 146. It will be seen that row #2 of the control holes is occupied by two adjoining control pins 146, located in the two leftmost tracks of the control drum. Row #3 of the control holes is occupied by a single control pin, located in the leftmost track of the drum. Row #4 of the control drum is occupied by two control pins 146, one located in the leftmost track and the other in the rightmost track.

The control drum of FIG. 15 in per se conventional manner is indexed row by row, in synchronism with the rotation of the needle cylinder. In conventional manner, a (non-illustrated) control chain composed of high and low links controls the indexing of the control drum. The chain is advanced one link per needle cylinder rotation. A high link causes the control drum to be advanced by one row, whereas a low link has no effect upon the control drum so that the control drum idles in the angular position thereof into which it was moved by the most recent high link of the control chain.

Let it be assumed that three successive links of the control chain are each high links and are associated with rows #2, #3 and #4 of the control drum of FIG. 15. Consequently, during the needle cylinder rotation corresponding to row #2, the left two yarn fingers will be activated and the striping box will feed the left two yarns. During the next needle cylinder rotation, only the leftmost yarn finger is activated, and only a single yarn is fed by the striping box. During the subsequent needle cylinder rotation, two yarns are again fed by the striping box, but now the leftmost and rightmost yarns.

It may be that during each of these three needle cylinder rotations the pattern wheel for the feeding station in question is programmed to merely lay in a float. In that event, during the first and third of these rotations a double thickness of yarn will be laid in as, for example, a two-color float, with the color combination being different for the two cylinder rotations. During the second of these rotations, on the other hand, only a single thickness of yarn will be fed as lay-in float.

If the feeding station provided with the striping box of FIG. 15 is provided with a conventional pattern placer mechanism (pattern wheel nullifier), then the latter may be programmed to override the pattern wheel of the feeding station during the second of the aforementioned three rotations. For example, during the first and third of the three rotations it may be desired to knit lay-in cloth wherein the lay-in float is a double-thickness two-color float, whereas during the second of these three rotations it may be desired to activate all pattern placer mechanisms (in proper sequence) so that a stripe of plain jersey cloth will be knit. In that event, the single yarn fed by the striping box of FIG. 15 during the second of the three cylinder rotations will be actually knit into stitches, and not merely laid in as a float in the formation of lay-in cloth.

It is to be understood that in principle more than two of the yarn-carrying fingers can be simultaneously activated, for example to form a three-color triple-thickness lay-in float for lay-in cloth.

It will be appreciated that the increase in design versatility and capability resulting with the expedients described above is very great. The number of combinations of multiple-thickness, multi-color threads which can be formed, as needed, is very considerable. Moreover, not one of the fingers of the striping box need be relegated to the carrying of a lay-in yarn too thick for actual knitting.

The invention has been illustrated and described as embodied in a circular knitting machine and a method of operating the same, where the circular knitting machine is provided with striping boxes which are operated by rotating control drums indexed in synchronism with the rotation of the needle cylinder of the knitting machine. However, the basic concept of the invention would also be applicable to knitting machines of different and especially more complicated design, for example, knitting machines in which the various control operations are performed not by cyclically operated cams and control chain links, but instead under the control of a programmed electronic computer, or the like.

The invention in its broadest aspect embraces the activation of more than one yarn-carrying finger, or other equivalent mechanism of a multi-finger striping box in general, so as to effect the feeding to needles of the yarn from more than one of the yarn-carrying fingers of the striping box at a time.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a striping box for circular knitting machines comprised of a rotating needle cylinder having cylinder needles, a plurality of yarn-carrying fingers, each finger being individually movable between an inoperative position and an operative position in which it feeds the yarn it carries to cylinder needles receiving yarn from the striping box; and means operative in synchronism with needle cylinder rotation for causing more than one of the yarn-carrying fingers to move into and stay in the operative position throughout at least one complete rotation of the needle cylinder to feed yarn from more than one finger at a time to cylinder needles receiving yarn from the striping box during the at least one complete rotation, said means comprising a control drum provided with a circumferential succession of axial holding slots for holding finger-activating jacks, an indexing arrangement operative for indexing the control drum slot-by-slot at preselected intervals each corresponding to at least one complete rotation of the needle cylinder; and finger-activating jacks removably held in said holding slots including at least one two-legged double jack, the double jack having a first leg portion lying in the associated axial holding slot and a second leg portion projecting radially outward of the control drum for finger activation, the breadth of the second leg portion measured in the axial direction of the control drum being such as to simultaneously activate more than one of the yarn-carrying fingers, the plurality of yarn-carrying fingers consisting of a first, second, third and fourth finger arranged successively in the stated order, the breadth of the second leg portion of the double jack and the location of the second leg portion relative to the yarn-carrying fingers being such that the second leg portion simultaneously activates only the second and third fingers.

2. In a striping box for circular knitting machines comprised of a rotating needle cylinder having cylinder needles, a plurality of yarn-carrying fingers, each finger being individually movable between an inoperative position and an operative position in which it feeds the yarn it carries to cylinder needles receiving yarn from the striping box; and means operative in synchronism with needle cylinder rotation for causing more than one of the yarn-carrying fingers to move into and stay in the operative position throughout at least one complete rotation of the needle cylinder to feed yarn from more than one finger at a time to cylinder needles receiving yarn from the striping box during the at least one complete rotation, said means comprising a control drum provided with a circumferential succession of axial holding slots for holding finger-activating jacks, an indexing arrangement operative for indexing the control drum slot-by-slot at preselected intervals each corresponding to at least one complete rotation of the needle cylinder; and finger-activating jacks removably held in said holding slots including at least one two-legged double jack, the double jack having a first leg portion lying in the associated axial holding slot and a second leg portion projecting radially outward of the control drum for finger activation, the breadth of the second leg portion measured in the axial direction of the control drum being such as to simultaneously activate more than one of the yarn-carrying fingers, the plurality of yarn-carrying fingers consisting of a first, second, third and fourth finger arranged successively in the stated order, the breadth of the second leg portion of the double jack and the location of the second leg portion relative to the yarn-carrying fingers being such that the second leg portion simultaneously activates only the first and second fingers, the control drum being provided with an annular groove extending circumferentially of the control drum midway between the axial ends of the control drum, the control drum being provided with an annular holding spring positioned in the annular groove, the double jack having at the juncture of its first and second leg portions a first holding recess and intermediate the first holding recess and the end of the first leg portion a second holding recess, the first leg portion lying in the associated axial holding slot with one of the two holding recesses in register with the annular groove, the first leg portion being radially inward of the holding spring, the holding spring being received within said one of the two holding recesses and holding the first leg portion in the axial slot, the first leg portion being shiftable in the axial direction of the control drum to a position in which the other of the two holding recesses comes into register with the annular groove and in which the holding spring is received in such other holding recess and in which the second leg portion simultaneously activates not the first and second fingers but instead the second and third fingers.

3. In a striping box for circular knitting machines comprised of a rotating needle cylinder having cylinder needles, a plurality of yarn-carrying fingers, each finger being individually movable between an inoperative position and an operative position in which it feeds the yarn it carries to cylinder needles receiving yarn from the striping box; and means operative in synchronism with needle cylinder rotation for causing more than one of the yarn-carrying fingers to move into and stay in the operative position throughout at least one complete rotation of the needle cylinder to feed yarn from more than one finger at a time to cylinder needles receiving yarn from the striping box during the at least one complete rotation, said means comprising a control drum provided with a circumferential succession of axial holding slots for holding finger-activating jacks, an indexing arrangement operative for indexing the control drum slot-by-slot at preselected intervals each corresponding to at least one complete rotation of the needle cylinder; and finger-activating jacks removably held in said holding slots including at least one generally L-shaped double jack, the double jack having a first leg portion lying in the associated axial holding slot and a second leg portion projecting radially outward of the control drum for finger activation, the breadth of the second leg portion measured in the axial direction of the control drum being such as to simultaneously activate more than one of the yarn-carrying fingers, the first and second leg portions being of substantially equal length, the double jack being removable from the holding slot for reinsertion with the second leg portion lying in the holding slot for finger activation by the first leg portion, the breadth of the first leg portion being such as to activate only one yarn-carrying finger.

4. In a striping box as defined in claim 2, the first and second leg portions being of substantially equal length, the double jack being generally L-shaped and removable from the holding slot for reinsertion with the second leg portion lying in the holding slot for finger activation by the first leg portion, the breadth of the first leg portion being such as to activate only one yarn-carrying finger.

* * * * *